US008616897B2

(12) United States Patent
Angerpointner

(10) Patent No.: US 8,616,897 B2
(45) Date of Patent: Dec. 31, 2013

(54) SLIP-RING UNIT

(75) Inventor: Ludwig Angerpointner, Muenchen (DE)

(73) Assignee: LTN Servotechnik GmbH, Otterfing (DE)

( * ) Notice: Subject to any disclaimer, the term of this patent is extended or adjusted under 35 U.S.C. 154(b) by 116 days.

(21) Appl. No.: 13/471,411

(22) Filed: May 14, 2012

(65) Prior Publication Data

US 2012/0289064 A1 Nov. 15, 2012

(30) Foreign Application Priority Data

May 14, 2011 (DE) ..... 10 2011 101 621

(51) Int. Cl.
*H01R 39/00* (2006.01)

(52) U.S. Cl.
USPC ..... 439/24

(58) Field of Classification Search
USPC ..... 439/23, 24, 25, 26, 28; 310/23
See application file for complete search history.

(56) References Cited

U.S. PATENT DOCUMENTS

| | | | | |
|---|---|---|---|---|
| 6,561,813 | B2 * | 5/2003 | Rutten et al. | 439/26 |
| 7,137,822 | B1 * | 11/2006 | Longmire et al. | 439/24 |
| 7,701,108 | B2 * | 4/2010 | Yu et al. | 310/232 |
| 7,764,002 | B2 * | 7/2010 | Yu et al. | 310/232 |
| 8,348,677 | B2 * | 1/2013 | Angerpointner et al. | 439/23 |
| 2009/0124098 | A1 * | 5/2009 | Yu et al. | 439/23 |

FOREIGN PATENT DOCUMENTS

| | | |
|---|---|---|
| EP | 0 662 736 | 7/1995 |

* cited by examiner

*Primary Examiner* — Phuong Dinh
(74) *Attorney, Agent, or Firm* — Kenyon & Kenyon LLP

(57) ABSTRACT

A slip-ring unit includes a first and a second group of components which are arranged in a manner allowing rotation relative to each other about an axis. The first group of components includes a slip-ring brush which is secured to a holder that is mounted between two components which are offset relative to each other in the direction of the axis. The second group of components includes at least one slip ring. The holder and at least one of the components each have an effective area by which a form-locking connection is produced between the holder and the at least one component. Forces having a directional component parallel to the axis are transmittable by the form-locking connection.

10 Claims, 3 Drawing Sheets

SLIP-RING UNIT

CROSS-REFERENCE TO RELATED APPLICATIONS

The present application claims priority to Application No. 10 2011 101 621.3, filed in the Federal Republic of Germany on May 14, 2011, which is expressly incorporated herein in its entirety by reference thereto.

FIELD OF THE INVENTION

The present invention relates to a slip-ring unit for transmitting electric currents between two groups of components rotatable relative to each other.

BACKGROUND INFORMATION

Slip-ring units are usually made up of two groups of components, namely, a stator and a rotor. The stator often includes slip-ring brushes, whereas the rotor usually has a succession of slip rings. During operation, the slip-ring brushes have sliding contact with the peripheral sides of the rotating slip rings. Such slip-ring units are used in many technical fields for transmitting electrical signals or electric power from a stationary unit to a rotating electrical unit.

European Published Patent Application No. 0 662 736 describes a slip ring in which a brush holder is supported by an annular member, the annular member being secured between two flanges.

SUMMARY

Example embodiments of the present invention provide a slip-ring unit which allows great reliability, and at the same time, is simple and economical to produce.

In the slip-ring unit for transmitting electric currents between a first and a second group of components, the two groups of components are disposed in a manner allowing rotation relative to each other about an axis. The first group of components, e.g., a stator, includes at least one slip-ring brush, which is secured to a holder that is mounted between two components which are offset relative to each other in the direction of the axis (for example, the components may be implemented as rings on the stator side). The second group of components, e.g., a rotor, has at least one slip ring. The holder and at least one of the components each have at least one effective area by which a form-locking connection is produced between the holder and the at least one component. Forces having a directional component parallel to the axis are transmittable by the form-locking connection.

Electric currents should be understood as currents which are necessary for transmitting electric power, but also currents which are in the form of signals, and are used only for transmitting information.

The slip-ring unit may be configured such that the holder and both specified components each have at least one effective area by which in each case, a form-locking connection is produced between the holder and the two components.

At least one of the components may have an undercut and the holder may include a projection, the undercut and the projection having mutually engaging effective areas and interacting such that between the holder and the at least one component, a form-locking connection is produced by which forces having a directional component parallel to the axis are transmittable. The slip-ring unit may be configured such that both components have an undercut. The slip-ring unit may be implemented so that the interacting effective areas of the holder and of the component engage with each other with an overlap in the circumferential direction. Alternatively or additionally, the slip-ring unit may be configured such that the interacting effective areas engage with each other with an overlap in the radial direction.

The slip-ring unit may be implemented such that axial tensile stresses are able to be introduced into the holder with the aid of the form-locking connection.

The first group of components may be rotatable relative to the second group of components with the aid of a rolling-contact bearing, and the component may be used for the axial securing of the rolling-contact bearing, and in particular, may be joined to the rolling-contact bearing for this purpose. For example, one of the components or both may be joined with form locking to an outer ring of a rolling-contact bearing, in order to take up axial forces. The rolling-contact bearing may be implemented such that it is able to transfer axial forces from the outer ring to the inner ring, e.g., when the rolling-contact bearing is in the form of a deep-groove ball bearing. Thus, the slip-ring unit may be configured so that axial forces are transferable by it between the first group of components and the second group of components, axial tensile stresses being able to be produced in the holder by the axial forces with the aid of the form-locking connection.

The first group of components may include a housing element, which is used as a form-locking, radial, retaining element for the form-locking connection between the holder and the at least one component. For example, the housing element may encircle the holder and the at least one component radially and without play in the area of the form-locking connection. In this context, the housing element may be hollow cylindrical or tubular. For example, the housing element may be used as a form-locking, radial, retaining element for form-locking connections at both components when the holder and both components each have at least one effective area by which in each case a form-locking connection is produced between the holder and the components.

The slip-ring unit may have a plurality of holders, in each case a form-locking connection being produced between the holders and the at least one component. For example, the slip-ring unit may have two holders which are offset by 180° about the axis (axis of rotation). Alternatively, three holders may also be provided, which are disposed at an angular separation of 120° relative to each other. Furthermore, four holders may be provided which, for example, are disposed at an angular displacement of 90° relative to each other.

Further features and aspects of example embodiments of the present invention are described in more detail below with reference to the appended Figures.

DETAILED DESCRIPTION

Figure 1:
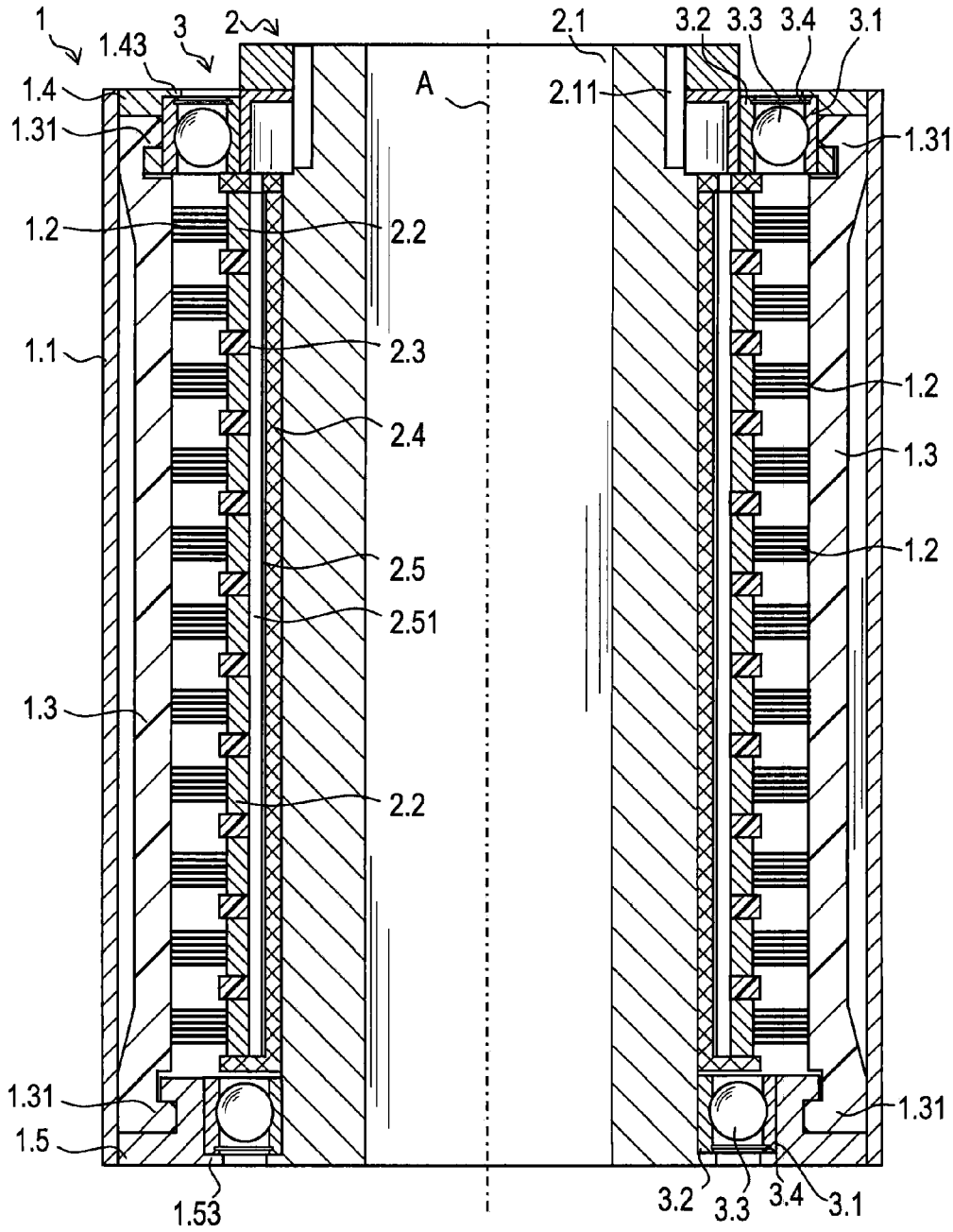
FIG. 1 is a longitudinal cross-sectional view of a slip-ring unit.

According to FIGS. 1, 2*a*, 2*b* and 2*c*, the slip-ring unit according to an example embodiment of the present invention includes a first group of components, which may be denoted as stator 1, and a second group of components, referred to as a rotor 2. The slip-ring unit is used to transmit electric currents between rotor 2 and stator 1, rotor 2 and stator 1 being disposed in a manner allowing rotation relative to each other about an axis A. Rotor 2 is supported with respect to stator 1 by rolling-contact bearings 3 which include an outer ring 3.1, an inner ring 3.2, as well as rolling elements 3.3 and a, e.g., rubbing seal 3.4. Rolling-contact bearing 3 is in the form of a deep-groove ball bearing, so that axial forces are thus transferable from outer ring 3.1 to inner ring 3.2, and vice versa.

Rotor 2 includes a shaft 2.1, which for example, takes the form of a hollow shaft. Radially outside of shaft 2.1 is, first of all, a substantially tubular component 2.4 which, for example, may be produced from aluminum. Adjacent to it further radially to the outside is a support tube 2.5 which has recesses 2.51 extending in the axial direction.

Fastened to electrically insulating support tube 2.5, which may be produced from plastic or ceramic, are twist-proof slip rings 2.2, which are separated at an axial distance from each other by electrically insulating rings 2.3. For clarity, the representation of electric lines is omitted in the Figures. Nevertheless, in the exemplary embodiment illustrated, each of the slip rings 2.2, mounted side-by-side at an axial distance, is connected at its inner side to an electric line which, in each case, is positioned along a recess 2.51 in the axial direction in rotor 2 and leaves rotor 2 through one of the grooves 2.11 at an axial end of shaft 2.1.

According to the exemplary embodiment illustrated, stator 1 has four holders 1.3 made of an insulating material, e.g., made of plastic, holders 1.3 being staggered in each case by 90° along a circumferential line. Holders 1.3 have a substantially cubic base body. Secured to each of holders 1.3 are slip-ring brushes 1.2 which are assigned to stator 1, and which touch slip rings 2.2 in a flexible manner. In the illustrated example embodiment, slip-ring brushes 1.2 are in the form of wire bundles. These slip-ring brushes 1.2 are connected electrically to lines with the aid of plated-through holes 1.33 (see FIGS. 2*b*, 2*c*) in the base body of holders 1.3. For clarity, representations of the electric lines on the stator side are omitted in FIGS. 2*b* and 2*c*.

Holders 1.3 have projections 1.31 which are integrally molded in claw-like fashion on the base body. Projections 1.31 have a substantially cylindrical basic form, the respective cylinder axes being aligned parallel to each other, e.g., projections 1.31 being oriented parallel to each other. Holder 1.3 is in one piece, and is produced from plastic with the aid of an injection-molding process, for example.

Both the slip-ring brushes 1.2 and slip rings 2.2 are arranged in the interior of a hollow-cylindrical housing element 1.1 to protect them from environmental influences. Moreover, the interior is bounded on the stator side by two components, e.g., two rings 1.4, 1.5. At the same time, these rings 1.4, 1.5 form the mounting support for outer rings 3.1 of rolling-contact bearings 3. For example, rings 1.4, 1.5 are used for the axial securing and axial prestressing of rolling-contact bearings 3. The transfer of force between outer rings 3.1 and rings 1.4, 1.5 is achieved through radial circumferential shoulders 1.43, 1.53 of rings 1.4, 1.5. Rolling-contact bearings 3 themselves are in the form of deep-groove ball bearings, so that axial forces are transferable by them from stator 1 to rotor 2 and vice versa.

Figure 2A:
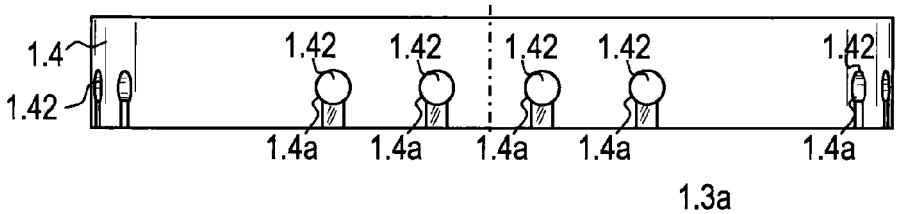
FIG. 2*a* is a detail view of a first component of the slip-ring unit.

As illustrated in FIG. 2*a*, ring 1.4 has a plurality, e.g., sixteen recesses (four groups offset by 90°, having four recesses each) which are terminated in the axial direction by bores, so that undercuts 1.42 are formed relative to the axial direction. Second ring 1.5 is also analogously configured, so that it likewise has sixteen recesses (four groups offset by 90°, having four recesses each), which are formed as undercuts 1.52.

Figure 2B:
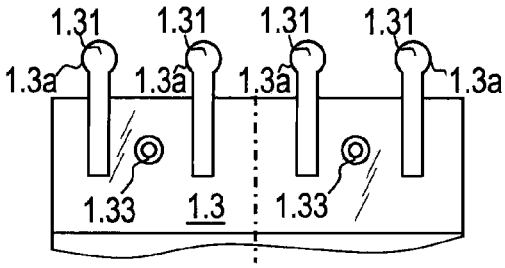
FIG. 2*b* is a detail view of a holder.
Figure 2C:
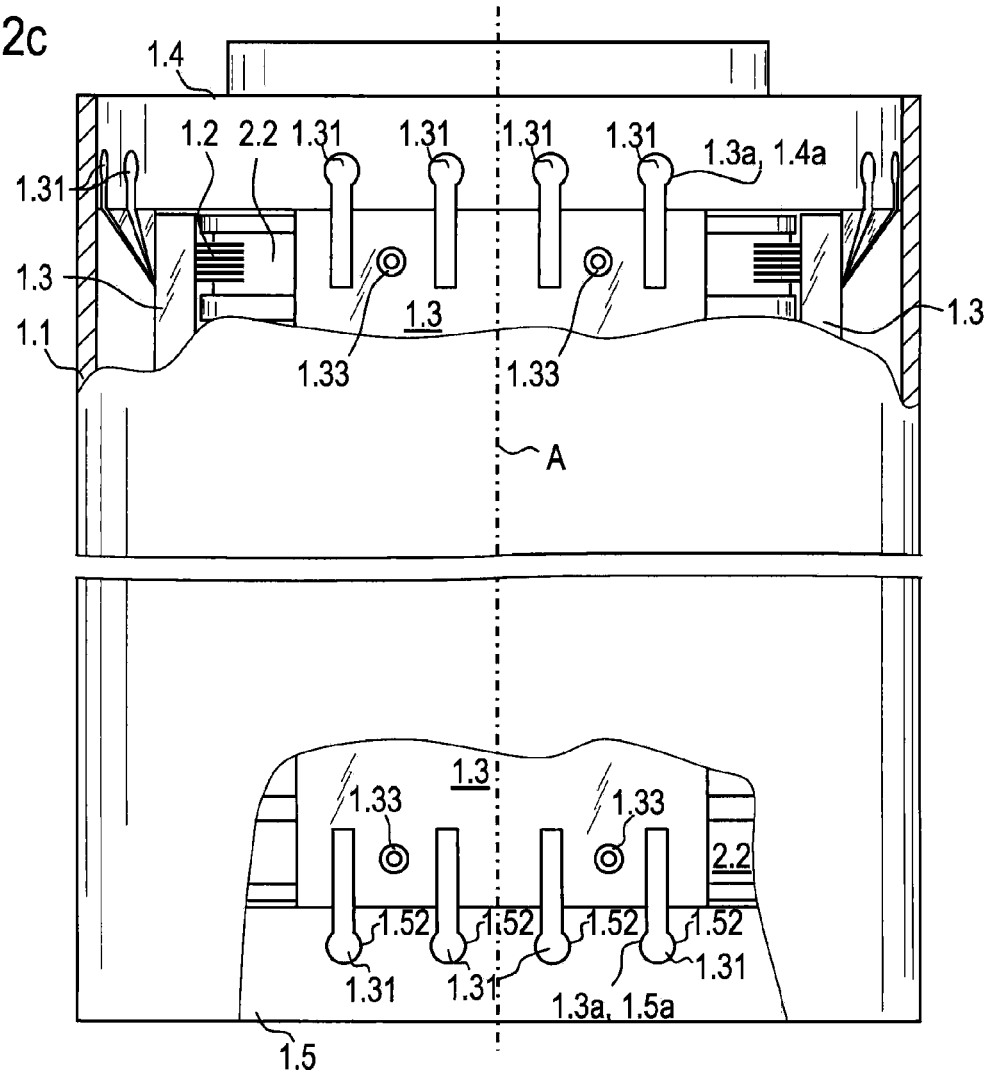
FIG. 2*c* is shows a partial cross-sectional view of the slip-ring unit.

In the course of assembling the slip-ring unit, projections 1.31 of each holder 1.3 are pressed into the recesses, e.g., undercuts 1.42, 1.52 of rings 1.4, 1.5. Then, as illustrated in FIG. 1, which represents a cross-sectional view that is produced through a line of intersection that extends through two outer projections 1.31 specific to holders 1.3, projections 1.31 of holders 1.3 engage with undercuts 1.42, 1.52 of first ring 1.4 and of second ring 1.5. In addition, effective areas 1.3*a*, 1.4*a*, 1.5*a* are illustrated in FIGS. 2*a* to 2*c*. Holder 1.3 and the two rings 1.4, 1.5 each have these effective areas 1.3*a*, 1.4*a*, 1.5*a*. Thus, a form-locking connection is produced between holder 1.3 and each of rings 1.4, 1.5 by effective areas 1.3*a*, 1.4*a*, 1.5*a*, which come into contact with each other and engage. In other words, in each case, a form-locking connection is produced that is obtained by the cooperation of undercuts 1.42, 1.52 with projections 1.31.

The axial distance between projections 1.31 at the axially opposing ends of holders 1.3, e.g., between associated effective areas 1.3*a*, is dimensioned so that (prior to mounting holder 1.3 on rings 1.4, 1.5) it is somewhat smaller than the axial distance between undercuts 1.42, 1.52, e.g., smaller than the axial distance between effective areas 1.4*a*, 1.5*a* of opposing rings 1.4, 1.5. Since holders 1.3 have this undersize, after assembly has been carried out, an axial prestress is obtained in holders 1.3. This prestress is transferred by shoulders 1.43, 1.53 to rolling-contact bearings 3, so that they are prestressed axially relative to each other. In this respect, axial tensile stresses are introduced into holder 1.3 with the aid of the form-locking connections.

Projections 1.31, integrally molded in claw-like fashion on the base body of holder 1.3, are implemented such that after assembly on rings 1.4, 1.5 has taken place, they are flush with the radial outer contour of rings 1.4, 1.5, e.g., with their outer surface. The radially outside contour of projections 1.31 is thus at least partially a cylindrical surface having the diameter of respective ring 1.4, 1.5 at its periphery. Thus, by pushing housing element 1.1 on, the connection, which is formed by the interaction of undercuts 1.42, 1.52 with projections 1.31, is radially secured.

Figure 3A:
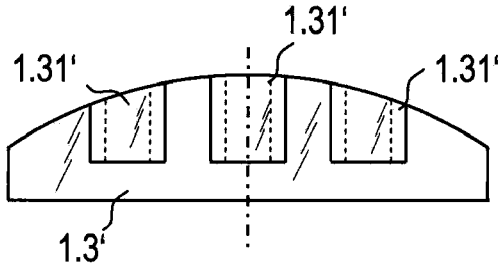
FIG. 3*a* is a side view of a holder.
Figure 3B:
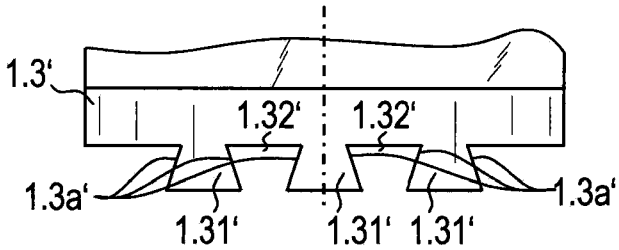
FIG. 3*b* is a partial top view of the holder illustrated in FIG. 3*a*.
Figure 3C:
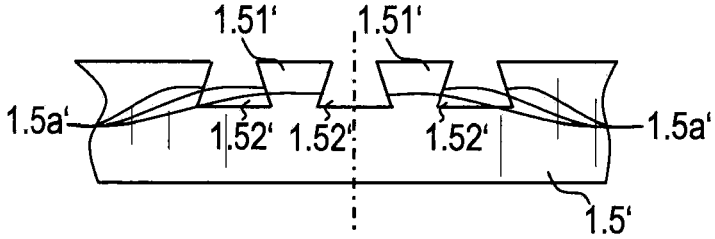
FIG. 3*c* is a detail view of a component of the slip-ring unit.

FIGS. 3*a*, 3*b*, and 3*c* show a further exemplary embodiment, which differs from the first exemplary embodiment mainly by the form of the form-locking connections.

FIG. 3*a* is a front view of a holder 1.3' without slip-ring brushes, holder 1.3' being formed analogously on its axially opposite face. Holder 1.3' has three dovetail-like projections 1.31' and undercuts 1.32' adjacent to them. The radial periphery of projections 1.31', e.g., of holder 1.3', is positioned on a circular line. Radially inside, projections 1.31' each have a contour which extends in a straight line and is oriented tangentially.

Alternatively, the corresponding contour may also be implemented such that it takes a course on a circular line, so that projections 1.31' are able to rest directly on the peripheral side of outer ring 3.1. The radius of the circular line may be exactly the same size as the outside radius of outer ring 3.1.

As illustrated in FIG. 3*b*, which is a top detail view of holder 1.3', projections 1.31' and undercuts 1.32' have effective areas 1.3*a*'. These effective areas 1.3*a*' are intended to interact with effective areas 1.5*a*' of a further component, which here is also implemented as ring 1.5'. Effective areas 1.5*a'* of ring 1.5' are located on three dovetail-like projections 1.51' and on undercuts 1.52' adjacent to them.

Figure 3D:
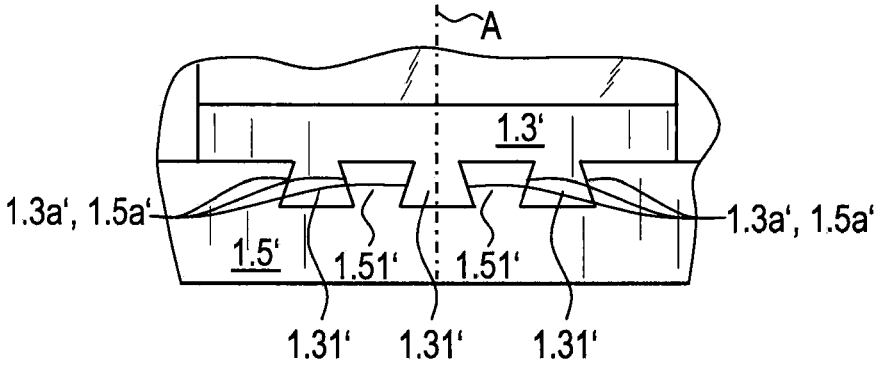
FIG. 3*d* is a detail view of a slip-ring unit.

After assembly, as illustrated in FIG. 3*d*, a form-locking connection is produced between holder 1.3' and ring 1.5', forces having a directional component parallel to axis A being transmittable by the form-locking connection. Effective areas 1.3*a'* and 1.5*a'* engage with each other. Even though FIG. 3*b* shows only one side of holder 1.3' on which a form-locking connection is attainable, in addition, the opposite side of the slip ring may be furnished with such a connection, as well. The same considerations with regard to the production of an axial prestress by an undersize of holder 1.3' hold true correspondingly for the second exemplary embodiment, as well. Likewise, housing element 1.1 is also used as a form-locking, radial, retaining element for the form-locking connection between meshing dovetail-like projections 1.31', 1.51' and undercuts 1.32', 1.52' in the second exemplary embodiment. The slip ring according to the second exemplary embodiment also has a plurality of holders 1.3' distributed over the periphery, four holders 1.3' being provided, for example.

What is claimed is:

1. A slip-ring unit for transmitting electric currents between components, comprising:

a first group of components including at least one slip-ring brush secured to a holder that is mounted between two first components that are offset relative to each other along an axis; and a second group of components including at least one slip ring, the two groups of components being rotatable relative to each other about the axis;

wherein the holder and at least one of the two components between which the holder is mounted each have an effective area that forms a form-locking connection between the holder and the at least one of the two components between which the holder is mounted, the form-locking connection adapted to transmit forces having a directional component parallel to the axis.

2. The slip-ring unit according to claim 1, wherein the holder and the two first components each have an effective area by which in each case a form-locking connection is produced between the holder and the components.

3. The slip-ring unit according to claim 1, wherein axial tensile stresses introducible to the holder by the form-locking connection.

4. The slip-ring unit according to claim 1, wherein the first group of components is rotatable relative to the second group of components by a rolling-contact bearing, and one of the two first components secures the rolling-contact bearing.

5. The slip-ring unit according to claim 4, wherein the rolling-contact bearing is adapted to transfer axial forces between the first group of components and the second group of components.

6. The slip-ring unit according to claim 1, wherein the first group of components is rotatable relative to the second group of components by two rolling-contact bearings, and each of the two first components axially secures a respective rolling-contact bearing.

7. The slip-ring unit according to claim 1, wherein the first group of components includes a housing element arranged as a form-locking, radial, retaining element for the form-locking connection.

8. The slip-ring unit according to claim 7, wherein the holder and the two first components have an effective area that forms a form-locking connection between the holder and the first components, and the housing element is arranged as a form-locking, radial, retaining element for the form-locking connections at both first components.

9. The slip-ring unit according to claim 7, wherein the housing element is arranged as a hollow cylinder.

10. The slip-ring unit according to claim 1, further comprising a plurality of holders.

* * * * *